US011001356B1

(12) United States Patent
Van Valkenburgh et al.

(10) Patent No.: US 11,001,356 B1
(45) Date of Patent: May 11, 2021

(54) ROLLABLE MAST FOR UNDERSEA VEHICLES

(71) Applicant: BAE SYSTEMS Information and Electronic Systems Integration Inc., Nashua, NH (US)

(72) Inventors: Christopher G. Van Valkenburgh, Manchester, NH (US); Ronald Carvalho, Bedford, NH (US); Robert J. Nation, Deerfield, NH (US); Charles P. Wason, Jr., Amherst, NH (US); Ross J. Wendell, Medford, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 16/715,481

(22) Filed: Dec. 16, 2019

(51) Int. Cl.
*B63G 8/04* (2006.01)
*H01Q 1/34* (2006.01)

(52) U.S. Cl.
CPC ..... *B63G 8/04* (2013.01); *H01Q 1/34* (2013.01); *B63B 2213/00* (2013.01); *B63B 2231/52* (2013.01)

(58) Field of Classification Search
CPC ..... H01Q 1/34; B63G 8/04; B63B 2213/00; B63B 2231/52
See application file for complete search history.

(56) References Cited

U.S. PATENT DOCUMENTS 2,763,341 A 9/1956 Wentworth
2,822,067 A * 2/1958 Price ..... H01Q 1/1235 52/121
3,213,573 A * 10/1965 Bohr ..... B21C 37/10 52/108
3,248,831 A * 5/1966 Jones ..... E04H 12/182 52/121
4,259,917 A 4/1981 Frank
4,426,650 A 1/1984 Korsen
5,619,946 A * 4/1997 Wallasch ..... B63H 9/1028 114/102.18
5,690,041 A * 11/1997 Hillenbrand ..... B63B 49/00 114/21.2
5,977,918 A * 11/1999 Sirmalis ..... H01Q 3/26 343/709
7,895,795 B1 * 3/2011 Murphey ..... E04C 3/28 52/108

(Continued)

*Primary Examiner* — S. Joseph Morano
*Assistant Examiner* — Jovon E Hayes
(74) *Attorney, Agent, or Firm* — Finch & Maloney PLLC; Scott J. Asmus

(57) ABSTRACT

A rollable mast system couplable to an undersea vehicle includes a mast made of a bi-stable composite material configured to roll onto itself in a first state and to stiffen into an elongated stable shape in a second state, and a head structure coupled to a distal end of the mast. The rollable mast system further includes a spool configured to support at least a portion of the bi-stable composite material in its first state and a roller in contact with the bi-stable composite material and configured to pay out the bi-stable composite material from the spool in a direction away from a hull of the undersea vehicle. The bi-stable composite material is in the first state as it passes from the spool to the roller, and the bi-stable composite material is in the second state after it passes the roller.

20 Claims, 8 Drawing Sheets

(56) References Cited

U.S. PATENT DOCUMENTS

2006/0272265 A1* 12/2006 Pryor ..... E04C 3/005
52/645
2017/0073053 A1* 3/2017 Clement ..... B63H 9/04

* cited by examiner

ROLLABLE MAST FOR UNDERSEA VEHICLES

BACKGROUND

Undersea vehicles typically use inertial measurement units (IMU) and other dead reckoning sensors to navigate while submerged since communications such as GPS do not operate undersea. While dead reckoning sensors may provide sole-source navigation for short duration missions, accumulation of navigation error eventually requires external measurements to maintain or restore accurate performance. Significant positioning error may be incurred in a matter of minutes or even seconds in certain situations. As a result, undersea vehicles regularly surface to receive GPS signals and other radio frequency (RF) transmissions, to obtain an accurate position fix from which dead reckoning navigation can then continue for a period of time or otherwise until another accurate position fix is needed. Such GPS or RF based navigation signals is typically received or transmitted from above the water's surface, which presents complications for an undersea vehicle, particularly those carrying out covert activities or that otherwise wish to remain submerged in the water during signal transmission.

BRIEF DESCRIPTION OF THE DRAWINGS

Features and advantages of embodiments of the claimed subject matter will become apparent as the following Detailed Description proceeds, and upon reference to the Drawings, in which:

Figure 1:
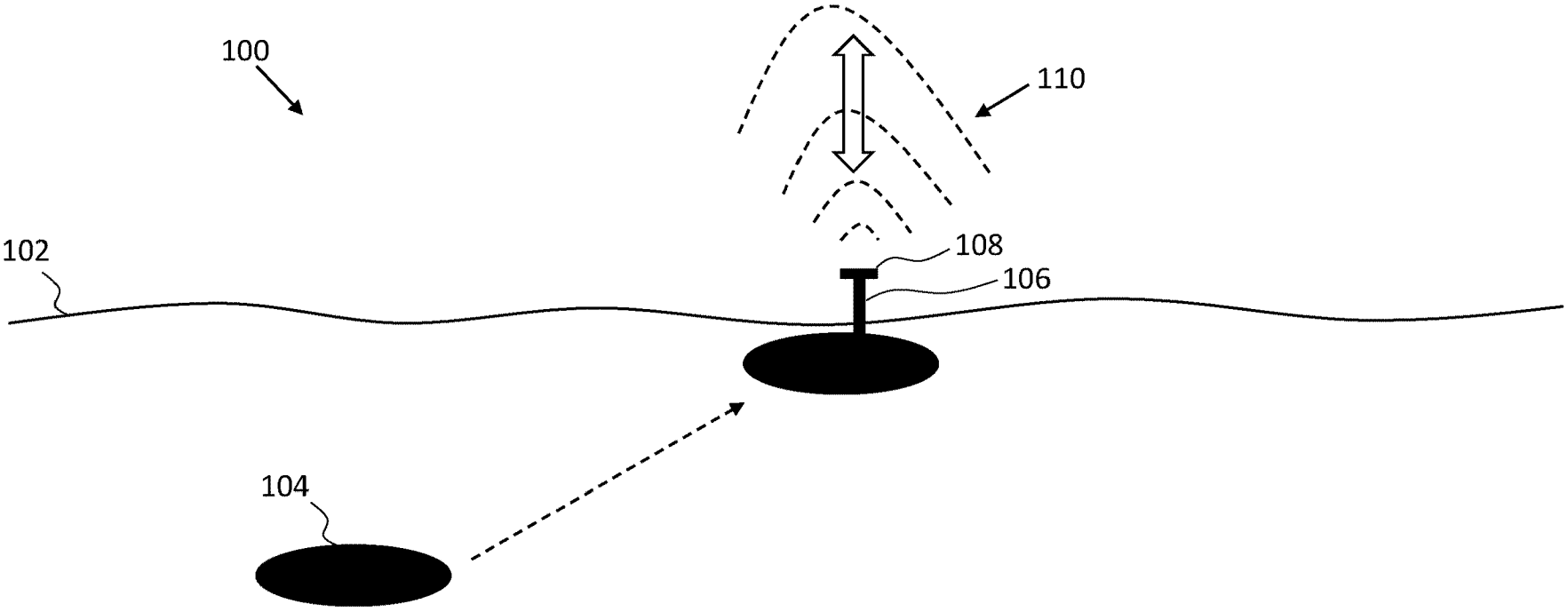
FIG. 1 illustrates an example undersea environment with an undersea vehicle configured with a rollable mast, in accordance with some embodiments of the present disclosure.

Although the following Detailed Description will proceed with reference being made to illustrative embodiments, many alternatives, modifications, and variations thereof will be apparent in light of this disclosure.

DETAILED DESCRIPTION

Methods and structures are disclosed for a rollable mast system for use on an undersea vehicle. In an embodiment, the mast system includes a bi-stable composite material that allows for first and second states of operation. In particular, the bi-stable composite material can be rolled into the undersea vehicle in a flexible first state that accommodates rolling-based retraction of the mast, and further can be selectively extended from the undersea vehicle in a rigid second state that accommodates a rigid extension of the mast. When extended, the mast allows the undersea vehicle to receive and transmit signals from above the water's surface while the undersea vehicle remains completely, or at least partially, submerged in the water, according to some such embodiments. Once the need for deployment of the rollable mast is satisfied, the mast can be retracted back into the undersea vehicle. Briefly, and according to some embodiments, the rollable mast extends outward from the undersea vehicle by a given height (e.g., within 1-2 meters, or more) and includes one or more electronic devices at a distal end of the rollable mast. The one or more electronic devices can, for example, transmit and/or receive various signals. In some embodiments, the one or more electronic devices or sensors are deployed on a head structure attached at the end of the rollable mast. In some such cases, the head structure is rigid or semi-rigid and shaped to match a contour of an outer panel or surface of the undersea vehicle. In this manner, when the mast is deployed the head structure is extended and the outer surface of the undersea vehicle is dimpled, and when the mast is stowed the head structure conforms to or otherwise seats into position so that the dimple of the outer surface is effectively filled. In some embodiments, the one or more electronic devices include one or more cameras or other sensors (e.g., temperature/heat sensors, radiation sensors, optical sensors, gas sensors, RF sensors). For example, undersea vehicles may raise sensors above the water's surface to communicate via RF or optical signals, or to observe above-water activity with cameras, electro-optical infrared sensors, radar, or RF sensors. The cameras may be arranged behind a transparent cover on the head structure to protect the cameras from water damage while still maintaining an optical view of the surroundings. Once signal transmission/reception or other sensor-based activity is complete, the rollable mast can be retracted back into the undersea vehicle and stowed such that the mast does not hinder movement of the undersea vehicle as it remains submerged and moves undersea.

Another possible way to achieve such benefits might be to use a rigid mast, such as a rigid mast that telescopes or extends away from the undersea vehicle, and that includes mounted devices at its distal end. However, the materials to make such a rigid mast are bulky and heavy, which limit how far the mast can reach above the water and thus further limit the feasibility of including the mast on some types of undersea vehicles (such as a water craft that is relatively small, or that cannot hold its position within the water with a very large mast extending therefrom, even with deployment of a counter-balance). Furthermore, the mechanisms needed for appropriately retracting rigid masts can be expensive and add further weight to the undersea vehicle.

According to some specific embodiments, the rollable mast material is a bi-stable fiberglass composite that holds its shape in two different states depending on how it is bent. In a first state, the rollable mast material rolls onto itself like a roll of tape and may be wound around a spool or other similar structure. Once one end of the rollable mast material is pulled away from the remainder of the roll, the material exhibits a second state where it curls inward from the sides and forms a rigid, elongated, tubular shape. The material forms the mast shape in its second state and can extend away from the undersea vehicle while maintaining its shape and rigidity. To retract the mast, the material is pulled back and rolled onto a spool or other similar structure where it naturally transitions from its second state back to its first state.

Accordingly, some embodiments herein describe a rollable mast for use on an undersea vehicle that alleviates all or some of the problems discussed when using rigid masts. According to one such embodiment, a rollable mast system couplable to an undersea vehicle includes a mast made of a bi-stable composite material configured to roll onto itself in a first state and to stiffen into an elongated stable shape in a second state, and a head structure coupled to a distal end of the mast. The head structure may have a rigid shape. In some such embodiments, the rollable mast system further includes a spool configured to support at least a portion of the bi-stable composite material in its first state and a roller, or a second spool, in contact with the bi-stable composite material and configured to pay out the bi-stable composite material from the spool in a direction away from a hull of the undersea vehicle. The bi-stable composite material is in the first state as it passes from the spool to the roller, and the bi-stable composite material is in the second state after it passes the roller. In some embodiments, the rollable mast system includes an actuator coupled to the roller and configured to adjust a pressure of the roller on the bi-stable composite material. The amount of applied pressure may be based on a wetness of the bi-stable composite material, measured using, for example, a wetness sensor, according to some embodiments.

An example method of providing a rollable mast onboard an undersea vehicle is provided. The method includes actuating a roller in contact with a bi-stable composite material such that the bi-stable composite material is paid out and extends away from the undersea vehicle. The bi-stable composite material is rolled onto itself in a first state prior to contact with the roller and is formed into an elongated, stiff second state after contact with the roller. The method continues with extending a compensation mass away from the vehicle to counteract the shift in the center of gravity of the undersea vehicle. Once the mast structure is fully deployed or otherwise rolled out, any number of above-surface observations can be made, using one or more sensors affixed to or otherwise included in a head structure at a distal end of the mast, or on the bi-stable composite material itself (e.g., camera to collect image data, optical receiver to collect optical signals, RF receiver to collect RF data, etc). Once the above-surface operations have been conducted, the method may continue with retracting the bi-stable composite material back towards the undersea vehicle by rolling the material around a spool or other similar structure within the undersea vehicle. In some embodiments, the method includes measuring a wetness of the bi-stable composite material and adjusting a pressure of the roller on the bi-stable composite material based on the measured wetness.

Numerous embodiments, variations, and applications will be appreciated in light of the disclosure herein.

FIG. 1 illustrates an example maritime environment 100 in which an undersea vehicle 104 moves beneath the water's surface 102. Undersea vehicle 104 may be any kind of submerged vehicle or platform, such as an unmanned undersea vehicle (UUV), although manned undersea vehicles can equally benefit as well. As further illustrated in FIG. 1, undersea vehicle 104 may approach the water's surface 102 and extend a rollable mast 106 having a head region 108 housing one or more electronic devices, according to an embodiment of the present disclosure.

In some embodiments, the one or more electronic devices of head region 108 includes one or more RF and/or optical receivers, transmitters, or transceivers for sending/receiving wireless communication signals 110 with, for example, a ship, aircraft, satellite, other undersea vehicle, or a land-based communication station. Data received by undersea vehicle 104 may include, for example, GPS signals to locate the undersea vehicle, messages/communications, or signals to program a processing device onboard undersea vehicle 104. Data transmitted by undersea vehicle 104 may include, for example, messages/communications, or data gathered from sensors onboard undersea vehicle 104 or on head region 108. Alternatively, or in addition, the one or more electronic devices of head region 108 may include one or more other sensors, such as a camera to capture above-surface images, a radiation sensor to detect the presence of above-surface radiation, a temperature sensor to detect the above-surface temperature, and/or a contact sensor or range-finder to detect the above-surface objects. In a more general sense, the one or more electronic devices of head region 108 may include any type of sensor or electronic equipment that can assist in communicating information to undersea vehicle 104 or from undersea vehicle 104, as will be appreciated.

Example embodiments provided herein describe using a rollable bi-stable material that includes an elongated, rigid shape to act as an elongated mast 106. Head region 108 disposed at the distal end of rollable mast 106 can be used to carry one or more electronic or sensor devices suitable for collecting and/or communicating data and/or messages. The relatively light weight of the mast material allows for taller masts to be realized, and for more electronic devices and/or heavier electronic devices to be included in head region 108.

Rollable Mast System Design

Figure 2A:
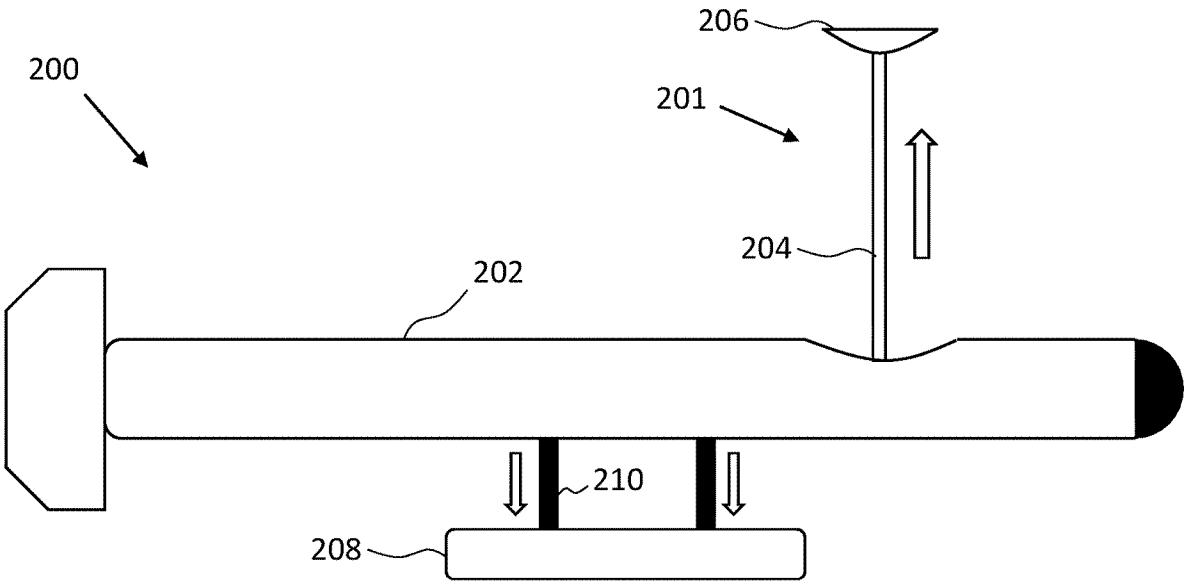
FIG. 2A illustrates a rollable mast extending from an undersea vehicle, in accordance with some embodiments of the present disclosure.
Figure 2B:
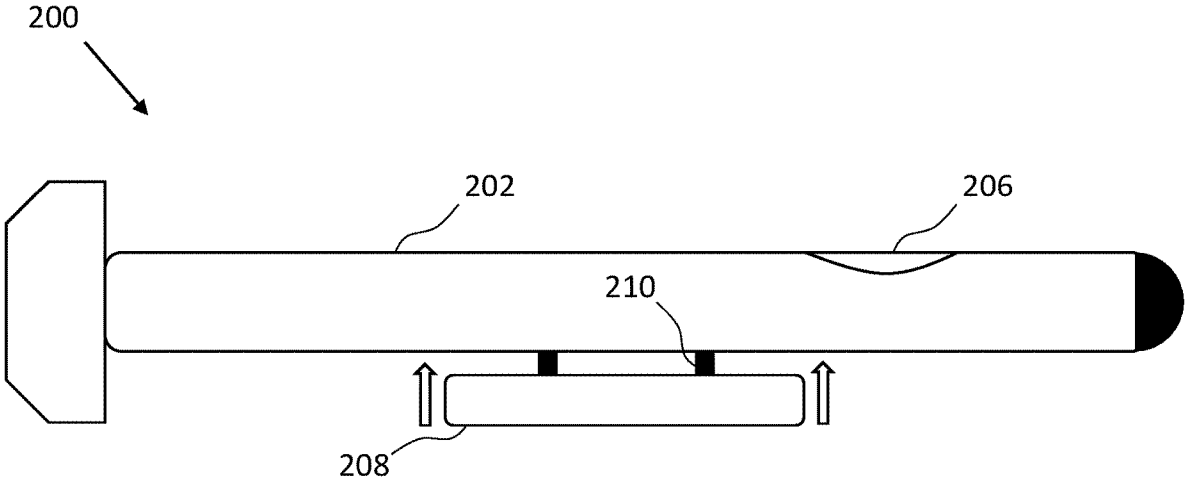
FIG. 2B illustrates the undersea vehicle of FIG. 2A having the rollable mast fully retracted, in accordance with some embodiments of the present disclosure.

FIG. 2A illustrates an example undersea vehicle 200 having a fully extended rollable mast structure 201, according to an embodiment. FIG. 2B illustrates undersea vehicle 200 with the mast fully retracted back within an outer surface (e.g., hull 202) of undersea vehicle 200.

Rollable mast structure 201 includes a bi-stable material 204 that provides the shape of the mast extending away from hull 202 of undersea vehicle 200 when bi-stable material 204 is paid out. In some embodiments, bi-stable material 204 can exist in a rolled up first state or a stiff, elongated second state. In the second elongated state, bi-stable material may be rolled from its sides into a cylindrical shape. In some embodiments, the bi-stable material in its second state does not form a complete cylinder, but rather includes a slit along its length where the edges of the bi-stable material curl towards one another but do not touch. In some such embodiments, the bi-stable composite material is more curved or otherwise less flat when in the second elongated state than when in the rolled up first state. Other elongated, stable shapes are possible as well. Bi-stable material 204 may be in a rolled up state within undersea vehicle 200 as described in more detail with reference to FIG. 3. Rollable mast structure 201 may have a height of at least 1 m. In some embodiments, rollable mast structure 201 has a height between 1 m and 2 m. Rollable mast 201 may be extended to any height so long as the extended mass can be effectively counterbalanced. Bi-stable material 204 may have sufficient rigidity to support up to about 20 pounds loaded onto its distal portion (e.g., head structure 206). In some embodiments, bi-stable material 204 may be further shaped as it is rolled out using collapsible rods or other similar rigid components, such as articulated rods. The collapsible or articulated rods may be woven into bi-stable material 204 or attached to a surface of bi-stable material 204.

Head structure 206 may be formed of any hard plastic, composite, or metal material. In some embodiments, head structure 206 is formed from acrylonitrile butadiene styrene (ABS) plastic (e.g., using a 3-D printer or injection molding, although any number of forming processes can be used). In one example the head structure includes a material that floats or includes air cells within the structure to provide floatation properties so that the head structure floats to the surface when deployed. In some embodiments, head structure 206 has a rigid shape that matches the contour of a panel of hull 202. In some embodiments, head structure 206 includes a rigid panel having an outer surface that is flush with an outer surface of hull 202 of the undersea vehicle when the mast structure 201 is in a stowed position. By matching the shape to an inset of hull 202, head structure 206 can return to a stowed position that is flush with hull 202 when rollable mast structure 201 is retracted into undersea vehicle 200 as seen in FIG. 2B.

According to some other embodiments, a separate, rigid panel that matches the contour of undersea vehicle 200 when mast structure 201 is stowed may be hinged at the base of mast structure 201, so that it moves out of the way of the mast during deployment. When the mast is retracted and stowed, the rigid cover hinges back over the mast opening in hull 202 to provide a contour matching, low drag outer envelope around hull 202. This design relaxes the form requirements for head structure 206 as it no longer needs to provide the sealed outer panel on hull 202. For example, head structure 206 may be made of the same material as bi-stable material 204.

Head structure 206 includes one or more electronic devices for transmitting/receiving signals. The electronic devices may include any one or more of GPS receivers, infrared cameras, visible light cameras, RF transceivers, radar jammers, radar transmitters, or identification friend or foe (IFF) transponders. The electronic devices may draw power from a power supply present on head structure 206. In some embodiments, the power supply includes rechargeable batteries that may be charged using harvestable energy sources. For example, solar cells may be used to harvest energy from the sun, piezoelectric devices may be used to harvest energy from motion or vibration, and miniature wind turbines may be used to harvest energy from the wind. According to some embodiments, the rechargeable batteries are charged using an external source via wired or wireless charging. Energy harvesting may also be done via the Peltier or Seebeck effect based on thermal differences.

The one or more electronic devices may be coupled to a top surface of head structure 206 and covered with a water-proof seal to prevent damage from the surrounding water. In some other embodiments, the one or more electronic devices are coupled to a bottom surface of head structure 206. In some other embodiments, the one or more electronic devices are integrated into the material of head structure 206. Portions of the one or more electronic devices may be located in different areas on head structure 206. For example, RF circuitry may be located on a bottom surface of head structure 206 while antennas coupled to the RF circuitry are located on a top surface of head structure 206. In some embodiments, head structure 206 acts as a base for other mounted structures that extend away from head structure 206, where the one or more electronic devices are coupled to the other mounted structures.

In some embodiments, head structure 206 includes one or more antennas or antenna arrays (collectively referred to as antenna elements) for transmitting/receiving signals. The antennas may include one or more patch antennas or microstrip antennas, according to some embodiments. In some embodiments, the one or more antennas support multiple communication bands (e.g., dual band operation or tri-band operation). Various ones of the antennas may support millimeter wave communications. Various ones of the antennas may support high band frequencies and low band frequencies. In some embodiments, the one or more antennas or antenna arrays may be woven into bi-stable material 204 or attached to an outer surface of bi-stable material 204.

The deployment of mast structure 201 may change the center of gravity for undersea vehicle 200. This may cause instability as undersea vehicle 200 attempts to maintain its position within the water. According to some embodiments, a compensation mass 208 is coupled to a bottom portion of undersea vehicle 200 using one or more coupling rods 210. Coupling rods 210 may be designed to extend and retract compensation mass 208 as needed to counteract any shift in the center of gravity of undersea vehicle 200 due to extending mast structure 201. For example, as mast structure 201 is extended away from undersea vehicle 200, compensation mass 208 may be simultaneously extended to maintain the center of gravity of undersea vehicle 200. FIG. 2B illustrates how compensation mass 208 is retracted up closer to undersea vehicle 200 when mast structure 201 is fully retracted. In some embodiments, compensation mass 208 may be retracted up into hull 202. Compensation mass 208 may be a tubular structure filled with materials having a particular density depending on the size/weight of undersea vehicle 200 compared to the size/weight of mast structure 201. Example materials to include within compensation mass 208 include sand and lead. In a further embodiment, the compensation mass is a bladder or ballast that fills with sea water or some other fluid when deployed to provide the compensation and the water or other fluid is removed as it is retrieved.

In some embodiments, compensation mass 208 is extended and/or retracting using any form of movable mechanism. In one example, compensation mass 208 is another mast structure including a bi-stable material that is deployed in a similar fashion as mast structure 201. Accordingly, each of the two different mast structures may be deployed by rotating different spools that each mast structure is wound around (as described in more detail in FIG. 3). In one embodiment, each of the two different mast structures may be wound around the same spool and moved simultaneously by rotating the same spool.

Although only one mast structure 201 is illustrated and described, it should be understood that any number of mast structures 201 may be included on undersea vehicle 200. In some embodiments, extending more than one mast structure 201 may be performed for stability reasons and to avoid greatly shifting the center of gravity of undersea vehicle 200.

Figure 3:
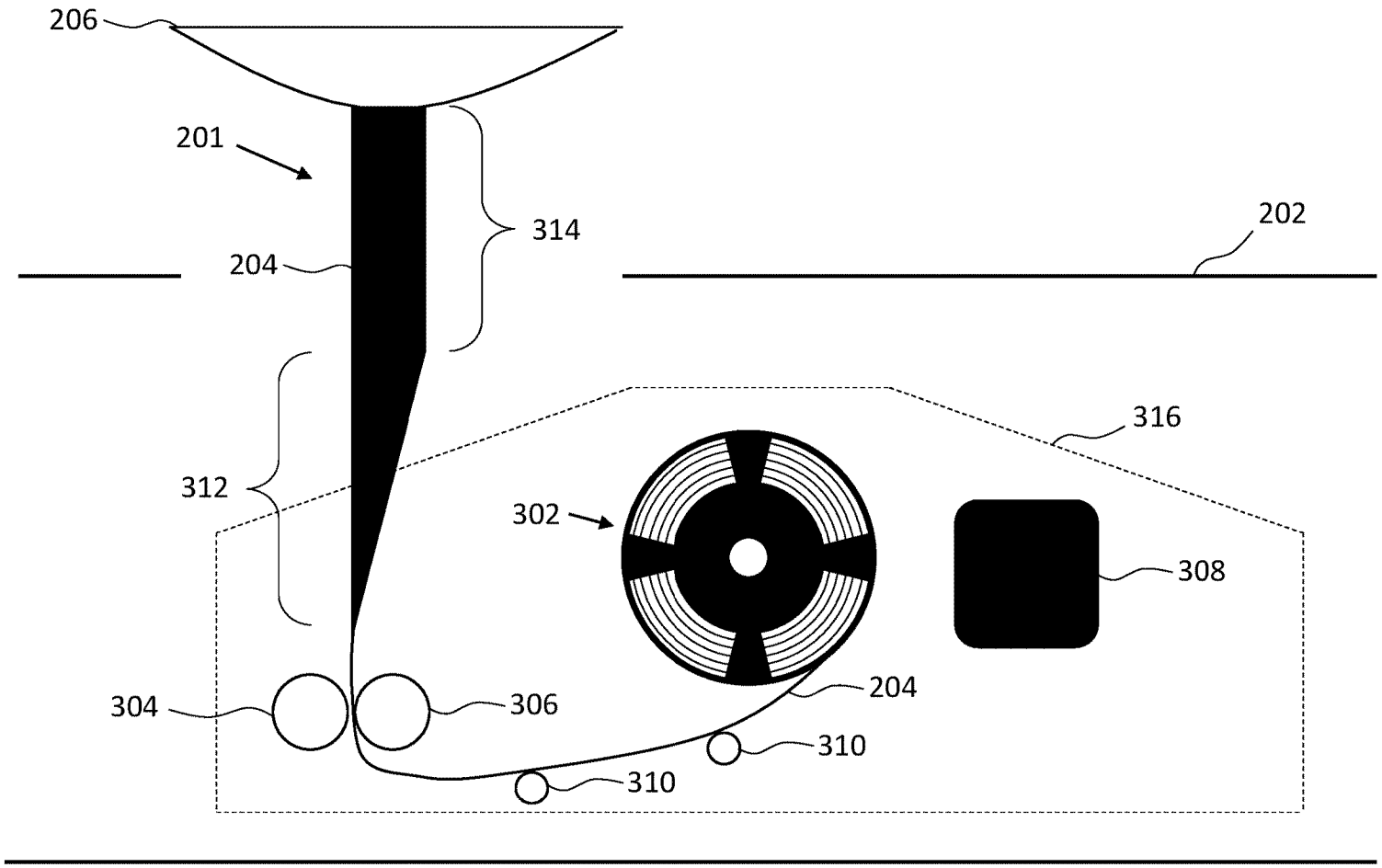
FIG. 3 illustrates a rollable mast system within an undersea vehicle, in accordance with an embodiment of the present disclosure.

FIG. 3 illustrates a more detailed view of the interior of undersea vehicle 200 showing how bi-stable material 204 is stowed within hull 202 and paid out, according to some embodiments. A carrier spool 302 may be mounted within a mounting brace 316 and designed to hold bi-stable material 204 in its rolled up state. Bi-stable material 204 may be wound around carrier spool 302 like a roll of tape and carrier spool 302 freely rotates to either pay out bi-stable material 204 or wind it back around carrier spool 302. According to some embodiments, bi-stable material 204 is passed from carrier spool 302 towards a set of smaller rollers to be ultimately directed out of hull 202. In some embodiments, carrier spool 302 has a diameter between about 3 inches and about 5 inches. A width of carrier spool 302 may be defined by the amount of space available within undersea vehicle 200 and by the width of mounting brace 316. In some embodiments, a width of carrier spool 302 is between about 6 inches and about 12 inches.

Bi-stable material 204 may pass between a first roller 304 and a drive roller 306. First roller 304 may be passive and freely rotates in a clockwise or counterclockwise direction. First roller 304 may have a low-friction surface. Drive roller 306 may have a roughened surface with a high friction force on bi-stable material 204 such that rotation of drive roller 306 moves bi-stable material 204 in a tangential direction along an edge of drive roller 306. For example, drive roller 306 may include a rubber material with a high friction coefficient such that clockwise rotation of drive roller 306 will push bi-stable material 204 upward and extend mast structure 201 out away from hull 202 while counterclockwise rotation of drive roller 306 will pull mast structure 201 back towards hull 202 and will wind bi-stable material 204 back around carrier spool 302. Rotation of drive roller 306 may be controlled by a motor 308. Any number of other rollers such as additional rollers 310 may be included within mounting brace 316 to assist in guiding bi-stable material 204 from carrier spool 302 to driver roller 306. In some embodiments, motor 308 also controls rotation of other spools or rollers, such as any of first roller 304, carrier spool 302, or additional rollers 310. In some embodiments, a toothed drive gear is used instead of a roller. The toothed drive gear engages with bi-stable material 204 through reciprocal holes and pays bi-stable material 204 in/out using a stepper motor to accurately control the position of bi-stable material 204.

According to some embodiments, the distance that bi-stable material 204 travels between carrier spool 302 and drive roller 306 is kept sufficiently short to ensure that bi-stable material 204 remains in its first state or close to its first state (e.g., mostly flat). As discussed above, once bi-stable material 204 is pulled far enough away from the remainder of its rolled body, it will transition to its second state and eventually take an elongated rigid shape in its second sate. As shown in FIG. 3, once bi-stable material 204 is paid out away from drive roller 306 and extends up towards the opening in hull 202, it goes through a transition phase 312 as it transitions from its first state to its second state. In some examples, this transition involves the edges of bi-stable material 204 beginning to curl inwards towards one another as the material transitions to forming a cylindrical shape. Following transition phase 312, bi-stable material 204 takes on an elongated, rigid shape in its second state 314. The elongated, rigid shape may be a cylinder, but other shapes are possible as well.

As bi-stable material 204 is extended away from hull 202 as part of mast structure 201, the material may become wet due to the surrounding water or do to weather conditions. When wet, bi-stable material 204 exhibits a different friction coefficient which may adversely affect the ability of drive roller 306 to move the material. Thus, and in accordance with some embodiments, the pressure exerted on bi-stable material 204 by driver roller 306 can be adjusted to account for the wetness of bi-stable material 204. One or more wetness sensors located on bi-stable material 204 or adjacent to bi-stable material 204 as it winds around carrier spool 302 may be used to measure a wetness level of bi-stable material 204. Depending on the measured wetness level, an actuator coupled to drive motor 308 may be used to linearly translate drive motor 308 either closer to or further from first roller 304 to apply either more pressure or less pressure, respectively, to bi-stable material 204. In some other embodiments, the revolutions per minute (RPM) of drive roller 306 is increased or decreased based on the measured wetness of bi-stable material 204.

In another embodiment, a torque sensor may be provided within hull 202 to measure the torque on drive roller 306 as it rotates to pay in/out bi-stable material 204. The measured torque can be correlated to the friction between drive roller 306 and bi-stable material 204. Depending on the measured torque, an actuator coupled to drive motor 308 may be used to linearly translate drive motor 308 either closer to or further from first roller 304 to apply either more pressure or less pressure, respectively, to bi-stable material 204. In some other embodiments, the revolutions per minute (RPM) of drive roller 306 is increased or decreased based on the measured torque.

Figure 4:
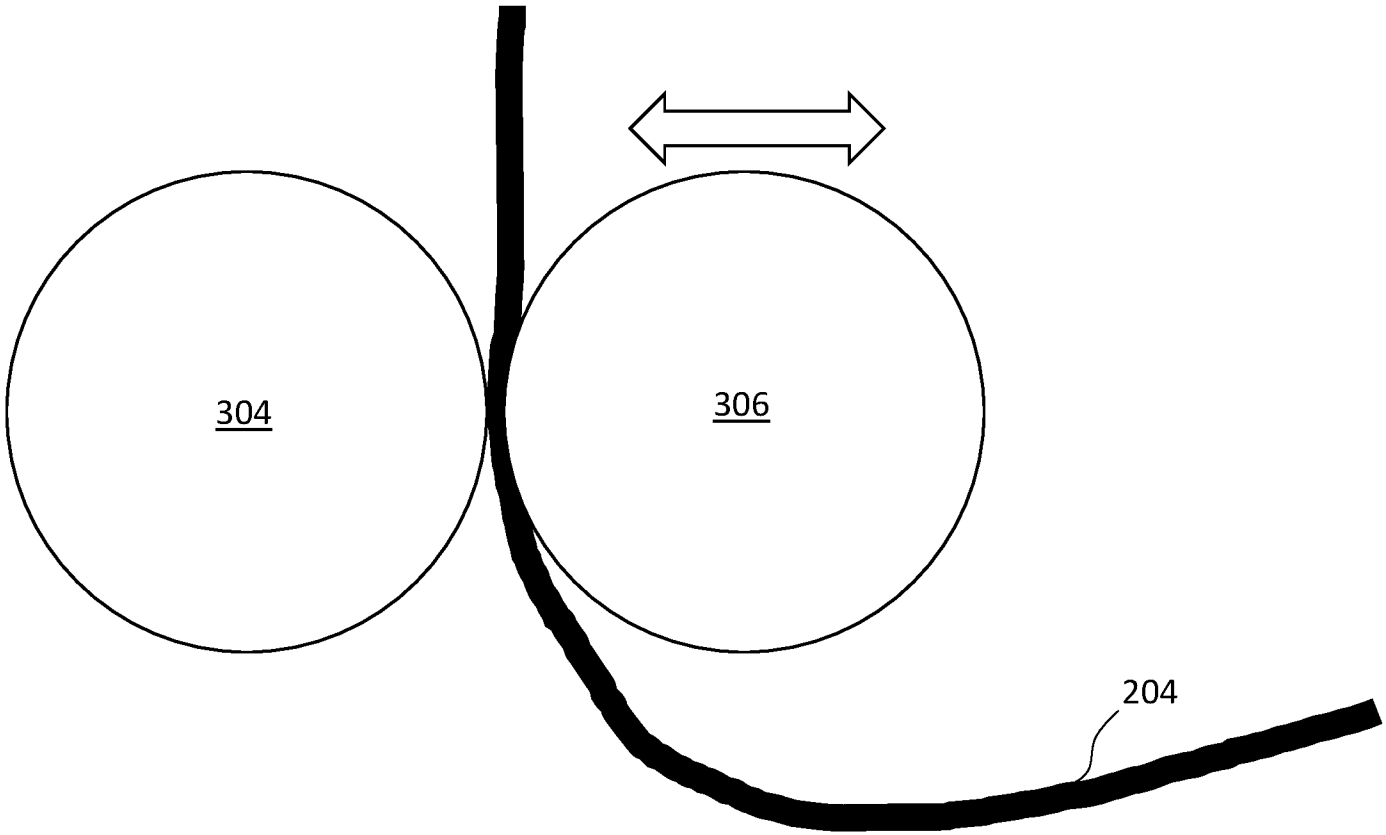
FIG. 4 illustrates a portion of the rollable mast system of FIG. 3, in accordance with an embodiment of the present disclosure.

FIG. 4 illustrate a closer view of first roller 304 and drive roller 306. The double ended arrow illustrates how drive roller 306 may apply more or less pressure on bi-stable material 204 as it passes between first roller 304 and drive roller 306. In some embodiments, a linear actuator may be used to move driver roller 306 either closer or further from first roller 304.

As discussed above, one or more electronic devices may be coupled to head structure 206. Such devices can have a power supply also coupled to head structure 206, or there may be a power supply within hull 202. When the power supply is located within hull 202, conductive wires are either embedded within bi-stable material 204 or run down a side of bi-stable material 204 to connect the one or more electronic devices on head structure 206 to the power supply within hull 202. The wires may be paid out with bi-stable material 204 using drive roller 306. When bi-stable material 204 is retracted around carrier spool 302, the wires may similarly be coiled around carrier spool 302 along with bi-stable material 204.

Figure 5:
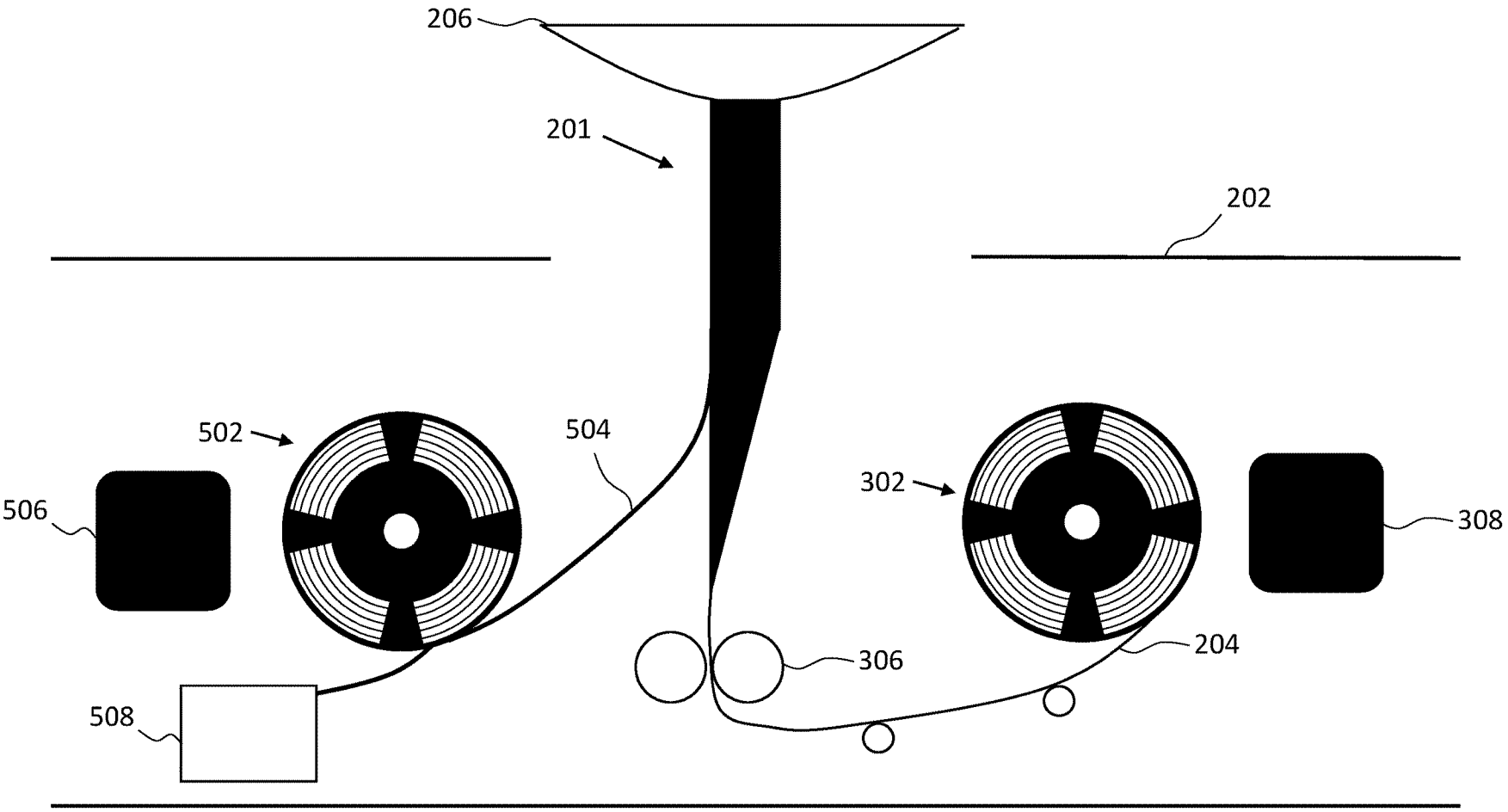
FIG. 5 illustrates another rollable mast system within an undersea vehicle, in accordance with another embodiment of the present disclosure.

FIG. 5 illustrates another view of the interior of undersea vehicle 200 showing the use of two spools, carrier spool 302 for paying out bi-stable material 204, and a second spool 502 for paying out wire(s) 504, according to an embodiment. Second spool 502 may be actuated by a separate motor 506, although in some other embodiments second spool 502 is actuated by the same motor 308 that controls drive roller 306. Second spool 502 may have the same relative size as carrier spool 302. In some embodiments, any number of other rollers may be used to guide wire(s) 504 towards bi-stable material 204, and any of these other rollers may be actively rotated using either motor 308 or motor 506.

Storing wire(s) 504 and bi-stable material 204 on separate spools may reduce tangling issues and avoids wire(s) 504 getting in the way when bi-stable material 204 is paid out using drive roller 306. In some embodiments, wire(s) 504 is coupled to the one or more electronic devices on head structure 206. As head structure 206 raises away from hull 202 by paying out bi-stable material 204, wire(s) 504 is pulled up as well and are paid out from second spool 502. In another embodiment, wire(s) 504 is brought together with bi-stable material 204 within hull 202 in a zipper-like arrangement where wire(s) 504 is connected to a side of bi-stable material 204 under, for example, a Velcro® or hook and loop sheath. The Velcro sheath may provide a cover over wire(s) 504 and is pulled away from bi-stable material 204 to allow wire(s) 504 to return to second spool 502. The Velcro sheath may be water resistant in that it is not adversely affected by the water, though the sheath does not need to provide a water-proof seal. In some embodiments, one end of wire(s) 504 is coupled to a power supply 508 within hull 202.

Figure 6C:
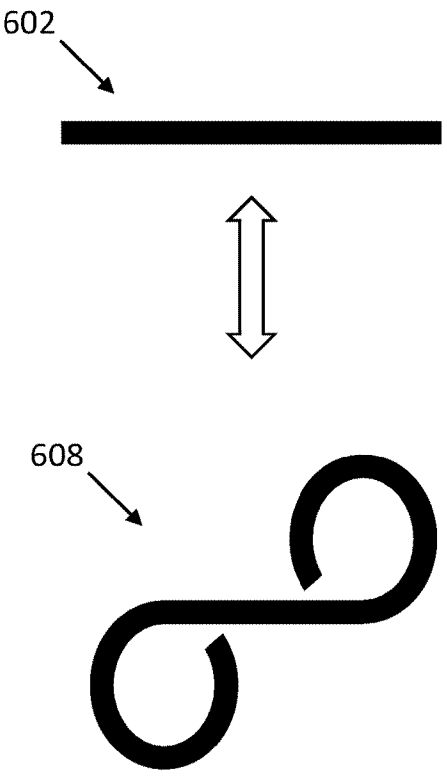
FIGS. 6A-6C illustrate example cross-section shapes of the rollable mast, in accordance with some embodiments of the present disclosure.
Figure 6B:
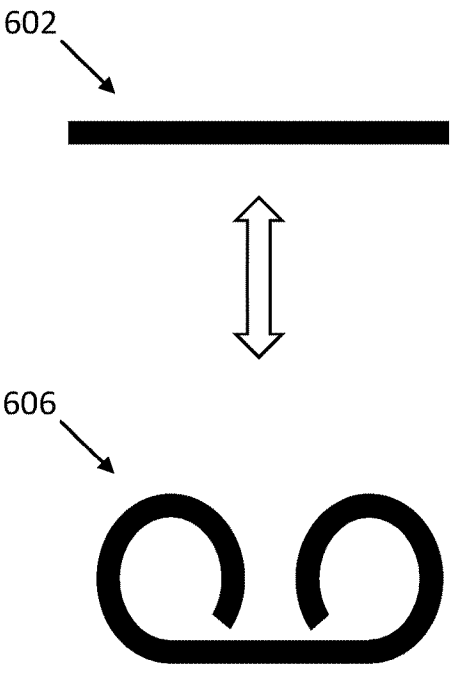
Figure 6A:
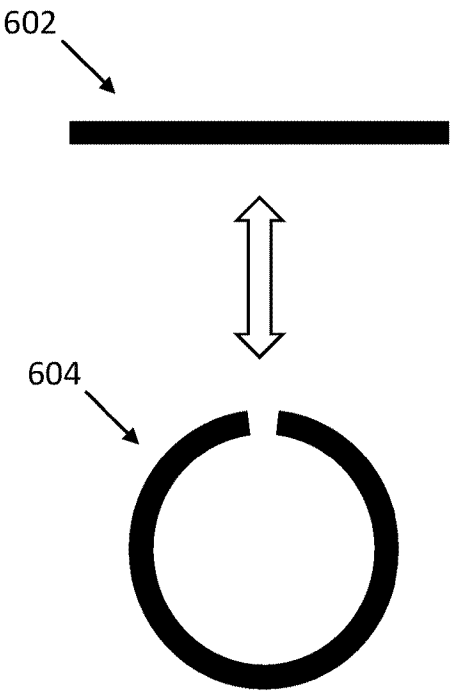

FIGS. 6A-6C illustrate different cross-section views of bi-stable material 204 in its first state and second state, according to some embodiments. Each of FIGS. 6A-6C illustrates one possible shape for the second state of bi-stable material 204, although other shapes beyond these examples are possible as well. The internal stress gradients of bi-stable material 204 may dictate the final shape of bi-stable material 204 when in its second state.

FIG. 6A illustrates a first state 602 of bi-stable material 204, where the material is relatively flat and can be easily rolled onto itself. In some embodiments, when in its first state, bi-stable material 204 forces itself into a rolled up shape. According to an embodiment, bi-stable material 204 has a cylindrical shape when in a second state 604. Note that relatively flat need not be perfectly flat, as there may be some relatively slight curvature, such as that associated with a metal tape measure that can coil back into a spool within a housing. The cylindrical shape of the second state is formed by the edges of bi-stable material 204 naturally curling towards one another when the material 204 is extended into an elongated position (rather than, for example, a coiled position). In some embodiments, the edges do not curl far enough to complete the cylinder and thus leave a slit between them. In some other embodiments, the edges curl far enough to touch one another. In any case, the first state 602 is relatively much flatter or less curved than the second state 604.

FIG. 6B illustrates the same first state 602 of bi-stable material 204. According to an embodiment, the edges of bi-stable material 204 each curl inwards more acutely when in a second state 606. This causes the edges to form an "eyeglasses" shape where two separate circular regions are formed.

FIG. 6C illustrates the same first state 602 of bi-stable material 204. According to an embodiment, the edges of bi-stable material 204 each curl acutely in the opposite direction when in a second state 608. This causes the edges to form two separate circular regions in a different manner than second state 606.

Example Undersea Vehicle Componentry

Figure 7:
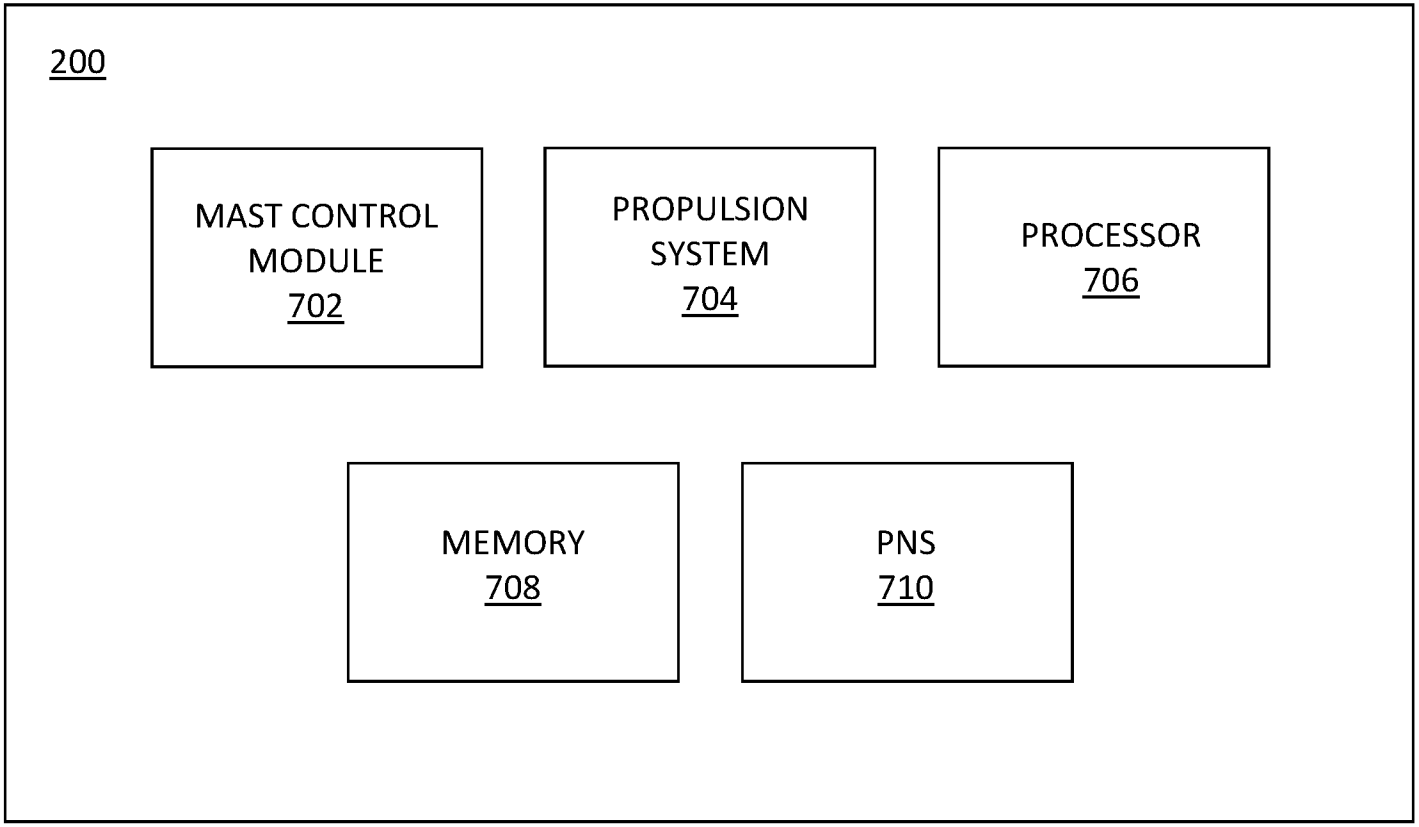
FIG. 7 illustrates select components of an undersea vehicle, in accordance with some embodiments of the present disclosure.

FIG. 7 illustrates components present within undersea vehicle 200, according to some embodiments. Undersea vehicle 200 may include a mast control module 702, a propulsion system 704, a processor 706, a memory 708, and a precision navigation system (PNS) 710.

Mast control module 702 can include any circuits and/or instructions stored in memory designed to control when to deploy the rollable mast and when to retract the rollable mast. In some embodiments, mast control module 702 represents a portion of processor 706 designed to control the operations of the rollable mast. In some embodiments, mast control module 702 also controls the operation of the one or more electronic devices present on the rollable mast.

Propulsion system 704 may include any number of elements involved in moving undersea vehicle 200 once it is submerged. Accordingly, propulsion system 704 may include a motor, a fuel source, and a propeller or jet nozzle. In some examples, the motor can turn the propeller in the water to move undersea vehicle 200. In some other examples, the motor can activate a pump that forces water out of the jet nozzle to move undersea vehicle 200. In another embodiment, the propulsion system may be a passive, buoyancy-based mechanism as used in some types of undersea gliders.

Processor 706 may represent one or more processing units that includes microcontrollers, microprocessors, application specific integrated circuits (ASICs), and field programmable gate arrays (FPGAs). According to some embodiments, processor 706 determines all of the operations performed by undersea vehicle 200. In some embodiments, processor 706 further controls all operations associated with the one or more electronic devices on the rollable mast.

Memory 708 may represent one or more memory devices that can be any type of memory. The memory devices can be one or more of DDR-SDRAM, FLASH, or hard drives to name a few examples. Navigational routes or any other data may be preloaded into memory 708 before undersea vehicle 200 is submerged. In some embodiments, data received or collected from any of the one or more electronic devices on the rollable mast are stored in memory 708.

PNS 710 may be included to provide additional data input for determining and/or refining the position of undersea vehicle 200. PNS 710 may include one or more inertial sensors that track movement of undersea vehicle 200.

Methodology

Figure 8:
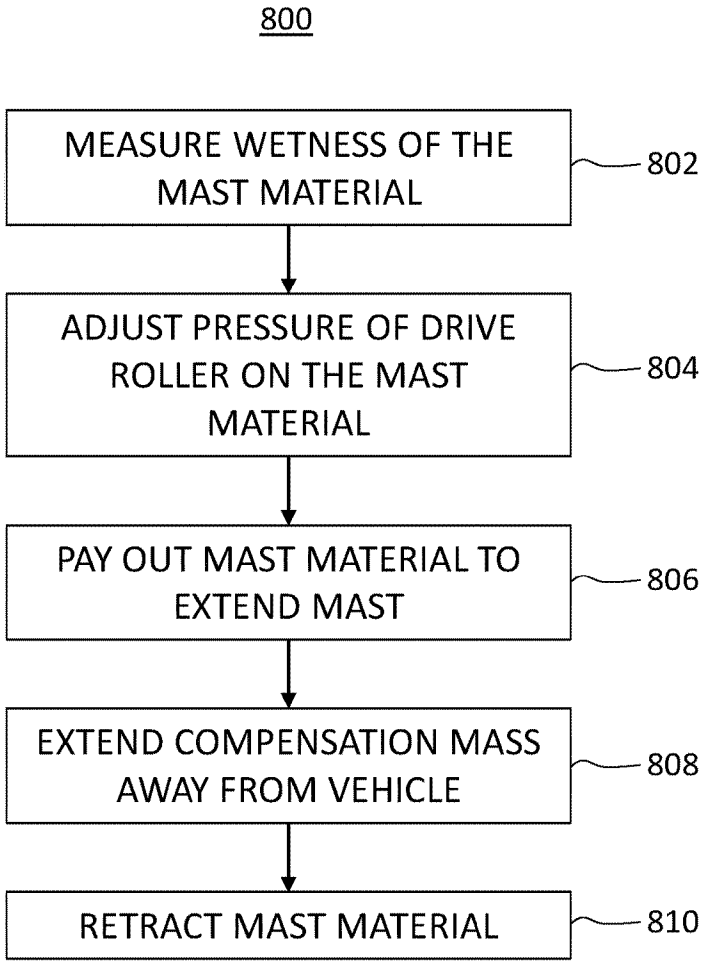
FIG. 8 is a flowchart illustrating an example method of operating a rollable mast system on an undersea vehicle, in accordance with some embodiments of the present disclosure.

FIG. 8 illustrates an example method 800 for providing a rollable mast onboard an undersea vehicle, in accordance with certain embodiments of the present disclosure. As can be seen, the example method includes a number of phases and sub-processes, the sequence of which may vary from one embodiment to another. However, when considered in the aggregate, these phases and sub-processes form a process for using the rollable mast system as described above with reference to FIG. 3. However other system architectures can be used in other embodiments, as will be apparent in light of this disclosure. To this end, the correlation of the various functions shown in FIG. 8 to the specific components illustrated in the other figures is not intended to imply any structural and/or use limitations. Rather, other embodiments may include, for example, varying degrees of integration wherein multiple functionalities are effectively performed by one system. Numerous variations and alternative configurations will be apparent in light of this disclosure.

Method 800 may begin at operation 802 where a sensor is used to measure a wetness of the mast material. The mast material includes a bi-stable composite material that forms into a first shape in a first state and into a second shape in a second state. The material can become wet as it is deployed for use on an undersea vehicle. The wetness of the material affects its coefficient of friction and affects how well it can be paid out using one or more drive rollers. The wetness sensor may be located anywhere on or adjacent to the mast material.

Method 800 continues with operation 804 where a pressure of a drive roller on the mast material is adjusted based on the measured wetness of the mast material. For example, if the mast material is determined to be sufficiently wet above a threshold value, then a drive roller may be actuated to press harder (e.g., apply more pressure) to the mast material as it rotates to pay out or retract the mast material. In other examples, if the mast material is determined to be sufficiently wet above a threshold value, then the RPM of the drive roller can be increased. In still other examples, the applied pressure and/or RPM of the drive roller can be continuously adjusted based on the measured wetness of the mast material.

Method 800 continues with operation 806 where the mast material is paid out to extend the mast away from the undersea vehicle. One or more drive rollers may be rotated to move the mast material from a spool within the undersea vehicle to extending out of the undersea vehicle as a rigid mast structure. The bi-stable material transitions from a first rolled-up state to a second stiff, elongated state as it is paid out from the one or more drive rollers.

Once the mast has been fully extended, one or more electronic devices or sensors present at a distal end of the mast may be used. Such devices may allow for RF communication to take place with satellites, other marine-based vehicles, or land-based signal towers. In some embodiments, one or more cameras may be present at the distal portion of the mast and used to take photographs or infrared images of the surrounding area. In some embodiments, the one or more electronic devices or sensors are coupled to a rigid head structure present at the distal end of the rollable mast.

Method 800 continues with operation 808 where a compensation mass is extended away from the undersea vehicle. The compensation mass may be extended to counteract the shift in the center of gravity caused by extending the rollable mast away from the undersea vehicle. Accordingly, the compensation mass may extend away from the undersea vehicle in an opposite direction from the rollable mast while the rollable mast is being extended such that operations 806 and 808 occur in parallel. The compensation mass may be a tubular structure filled with materials having a particular density depending on the size/weight of the undersea vehicle compared to the size/weight of the rollable mast structure. Example materials to include within the compensation mass include sand and lead.

Method 800 continues with operation 810 where the mast material is retracted back inside the undersea vehicle. One or more drive rollers may be rotated to retract the mast material from its elongated state back around a spool within the undersea vehicle. Any of the one or more drive rollers may be the same drive rollers used to pay out the mast as described in operation 806. The bi-stable material transitions from a stiff, elongated state to a rolled-up state as it is retracted around the spool using the one or more drive rollers.

Unless specifically stated otherwise, it may be appreciated that terms such as "processing," "computing," "calculating," "determining," or the like refer to the action and/or process of a computer or computing system, or similar electronic computing device, that manipulates and/or transforms data represented as physical quantities (for example, electronic) within the registers and/or memory units of the computer system into other data similarly represented as physical quantities within the registers, memory units, or other such information storage transmission or displays of the computer system. The embodiments are not limited in this context.

The terms "circuit" or "circuitry," as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry. The circuitry may include a processor and/or controller configured to execute one or more instructions to perform one or more operations described herein. The instructions may be embodied as, for example, an application, software, firmware, etc. configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads, etc., in a hierarchical fashion. Firmware may be embodied as code, instructions or instruction sets and/or data that are hard-coded (e.g., non-volatile) in memory devices. The circuitry may, collectively or individually, be embodied as circuitry that forms part of a larger system, for example, an integrated circuit (IC), an application-specific integrated circuit (ASIC), a system on-chip (SoC), desktop computers, laptop computers, tablet computers, servers, smart phones, etc. Other embodiments may be implemented as software executed by a programmable control device. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

FURTHER EXAMPLE EMBODIMENTS

The following examples pertain to further embodiments, from which numerous permutations and configurations will be apparent.

Example 1 is a rollable mast system for use in an undersea vehicle. The rollable mast system includes a mast comprising a bi-stable composite material, a head structure having a rigid or semi-rigid shape and coupled to a distal end of the mast, a spool, and a roller. The bi-stable composite material is configured to roll onto itself in a first state and to stiffen into an elongated stable shape in a second state. The spool supports at least a portion of the bi-stable composite material in its first state. The roller is in contact with the bi-stable composite material and is configured to pay out the bi-stable composite material from the spool in a direction away from a hull of the undersea vehicle. The bi-stable composite material is in the first state as it passes from the spool to the roller, and the bi-stable composite material is in the second state after it passes the roller.

Example 2 includes the subject matter of Example 1, wherein the mast extends away from the hull of the undersea vehicle by anywhere between 1-2 meters.

Example 3 includes the subject matter of Example 1 or 2, wherein the head structure comprises one or more electronic devices.

Example 4 includes the subject matter of Example 3, further comprising one or more conductive wires coupled between the one or more electronic devices and a power supply in the undersea vehicle.

Example 5 includes the subject matter of any one of Examples 1-4, wherein the rigid or semi-rigid shape of the head structure is shaped to match a contour of the hull of the undersea vehicle.

Example 6 includes the subject matter of any one of Examples 1-5, further comprising one or more antenna elements on the head structure.

Example 7 includes the subject matter of any one of Examples 1-6, further comprising one or more antenna elements embedded in the bi-stable composite material.

Example 8 includes the subject matter of any one of Examples 1-7, further comprising one or more cameras on the head structure.

Example 9 includes the subject matter of any one of Examples 1-8, further comprising a compensation mass configured to extend away from the hull when the mast is extended away from the hull.

Example 10 includes the subject matter of any one of Examples 1-9, further comprising a wetness sensor coupled to the bi-stable composite material.

Example 11 includes the subject matter of Example 10, further comprising an actuator coupled to the roller and configured to affect a pressure exerted on the bi-stable composite material by the roller based on a measurement from the wetness sensor.

Example 12 includes the subject matter of any one of Examples 1-11, further comprising a motor configured to turn at least the roller.

Example 13 includes the subject matter of Example 12, wherein the motor is further configured to turn the spool.

Example 14 includes the subject matter of any one of Examples 1-13, wherein the spool is a first spool and the rollable mast system further comprises a second spool configured to support one or more wires, wherein rotating the second spool pays out the one or more wires alongside the bi-stable composite material in its second state.

Example 15 is a rollable mast system for use in an undersea vehicle. The rollable mast system includes a mast comprising a bi-stable composite material, a spool, a roller, and an actuator. The bi-stable composite material is configured to roll onto itself in a first state and to stiffen into an elongated stable shape in a second state. The bi-stable composite material is more curved when in the second state than when in the first state. The spool supports at least a portion of the bi-stable composite material in its first state. The roller is in contact with the bi-stable composite material and is configured to pay out the bi-stable composite material from the spool in a direction away from a hull of the undersea vehicle. The actuator adjusts a pressure of the roller on the bi-stable composite material. The bi-stable composite material is in the first state as it passes from the spool to the roller, and the bi-stable composite material is in the second state after it passes the roller.

Example 16 includes the subject matter of Example 15, wherein the mast extends away from the hull of the undersea vehicle by anywhere between 1-2 meters.

Example 17 includes the subject matter of Example 15 or 16, wherein a distal end of the mast comprises a rigid head structure having one or more electronic devices.

Example 18 includes the subject matter of Example 17, further comprising one or more conductive wires coupled between the one or more electronic devices and a power supply in the undersea vehicle.

Example 19 includes the subject matter of any one of Examples 15-18, further comprising a compensation mass configured to extend away from the hull when the mast is extended away from the hull.

Example 20 includes the subject matter of any one of Examples 15-19, further comprising a wetness sensor coupled to the bi-stable composite material.

Example 21 includes the subject matter of Example 20, wherein the actuator is configured to affect the pressure exerted on the bi-stable composite material by the roller based on a measurement from the wetness sensor.

Example 22 includes the subject matter of any one of Examples 15-21, further comprising a motor configured to turn at least the roller.

Example 23 includes the subject matter of Example 22, wherein the motor is further configured to turn the spool.

Example 24 includes the subject matter of any one of Examples 15-23, wherein the spool is a first spool and the rollable mast system further comprises a second spool configured to support one or more wires, wherein rotating the second spool pays out the one or more wires alongside the bi-stable composite material in its second state.

Example 25 is a method of providing a rollable mast onboard an undersea vehicle. The method includes actuating a roller in contact with a bi-stable composite material such that the bi-stable composite material is paid out and extends away from the undersea vehicle, wherein the bi-stable composite material is rolled onto itself in a first state prior to contact with the roller and is formed into an elongated, stiff second state after contact with the roller. The method also includes actuating the roller such that the bi-stable composite material is retracted back into the undersea vehicle.

Example 26 includes the subject matter of Example 25, further comprising measuring a wetness of the bi-stable composite material using a wetness sensor.

Example 27 includes the subject matter of Example 26, further comprising adjusting a pressure of the roller on the bi-stable composite material based on the measured wetness.

Example 28 includes the subject matter of any one of Examples 25-27, further comprising extending a compensation mass away from the undersea vehicle to counteract the shift in the center of gravity of the undersea vehicle.

Numerous specific details have been set forth herein to provide a thorough understanding of the embodiments. It will be appreciated, however, that the embodiments may be practiced without these specific details. In other instances, well known operations, components and circuits have not been described in detail so as not to obscure the embodiments. It can be further appreciated that the specific structural and functional details disclosed herein may be representative and do not necessarily limit the scope of the embodiments. In addition, although the subject matter has been described in language specific to structural features and/or methodological acts, it is to be understood that the subject matter defined in the appended claims is not necessarily limited to the specific features or acts described herein. Rather, the specific features and acts described herein are disclosed as example forms of implementing the claims.

What is claimed is:

1. A rollable mast system configured for use in an undersea vehicle, the rollable mast system comprising:

a mast comprising a bi-stable composite material configured to roll onto itself in a first state and to stiffen into an elongated stable shape in a second state;

a head structure coupled to a distal end of the mast, the head structure having a rigid or semi-rigid shape;

a spool configured to support at least a portion of the bi-stable composite material in its first state;

a roller in contact with the bi-stable composite material and configured to pay out the bi-stable composite material from the spool in a direction away from a hull of the undersea vehicle; and at least one wetness sensor coupled to the bi-stable composite material;

wherein the bi-stable composite material is in the first state as it passes from the spool to the roller, and the bi-stable composite material is in the second state after it passes the roller.

2. The rollable mast system of claim 1, wherein the mast extends away from the hull of the undersea vehicle by anywhere between 1-2 meters.

3. The rollable mast system of claim 1, wherein the head structure comprises one or more electronic devices including one or more antenna elements.

4. The rollable mast system of claim 1, wherein the rigid or semi-rigid shape of the head structure is shaped to match a contour of the hull of the undersea vehicle.

5. The rollable mast system of claim 1, further comprising one or more antenna elements embedded in the bi-stable composite material.

6. The rollable mast system of claim 1, further comprising one or more cameras on the head structure.

7. The rollable mast system of claim 1, further comprising a compensation mass configured to extend away from the hull when the mast is extended away from the hull.

8. The rollable mast system of claim 1, further comprising an actuator coupled to the roller and configured to affect a pressure exerted on the bi-stable composite material by the roller based on a measurement from the wetness sensor.

9. The rollable mast system of claim 1, wherein the spool is a first spool and the rollable mast system further comprises a second spool configured to support one or more wires, wherein rotating the second spool pays out the one or more wires alongside the bi-stable composite material in its second state.

10. A rollable mast system configured for use in an undersea vehicle, the rollable mast system comprising:

a mast comprising a bi-stable composite material configured to roll onto itself in a first state and to stiffen into an elongated stable shape in a second state, wherein the bi-stable composite material is more curved when in the second state than when in the first state;

a spool configured to support at least a portion of the bi-stable composite material in its first state;

a roller in contact with the bi-stable composite material and configured to pay out the bi-stable composite material from the spool in a direction away from a hull of the undersea vehicle; and an actuator configured to adjust a pressure of the roller on the bi-stable composite material;

wherein the bi-stable composite material is in the first state as it passes from the spool to the roller, and the bi-stable composite material is in the second state after it passes the roller.

11. The rollable mast system of claim 10, wherein the mast extends away from the hull of the undersea vehicle by anywhere between 1-2 meters.

12. The rollable mast system of claim 10, wherein a distal end of the mast comprises a rigid head structure having one or more electronic devices.

13. The rollable mast system of claim 10, further comprising a compensation mass configured to extend away from the hull when the mast is extended away from the hull.

14. The rollable mast system of claim 10, further comprising a wetness sensor coupled to the bi-stable composite material.

15. The rollable mast system of claim 14, wherein the actuator is configured to affect the pressure exerted on the bi-stable composite material by the roller based on a measurement from the wetness sensor.

16. The rollable mast system of claim 10, wherein the spool is a first spool and the rollable mast system further comprises a second spool configured to support one or more wires, wherein rotating the second spool pays out the one or more wires alongside the bi-stable composite material in its second state.

17. A method of providing a rollable mast onboard an undersea vehicle, the method comprising:

actuating a roller in contact with a bi-stable composite material such that the bi-stable composite material is paid out and extends away from the undersea vehicle, wherein the bi-stable composite material is rolled onto itself in a first state prior to contact with the roller and is formed into an elongated, stiff second state after contact with the roller;

actuating the roller such that the bi-stable composite material is retracted back into the undersea vehicle; and measuring a wetness of the bi-stable composite material using at least one wetness sensor.

18. The method of claim 17, further comprising adjusting a pressure of the roller on the bi-stable composite material based on the measured wetness.

19. The rollable mast system of claim 1, further comprising one or more sensors on the head structure.

20. The rollable mast system of claim 19, wherein the one or more sensors comprises for temperature, radiation, optical, gas, and RF sensors.

* * * * *